US009200442B2

(12) United States Patent
Richards

(10) Patent No.: US 9,200,442 B2
(45) Date of Patent: Dec. 1, 2015

(54) STRUCTURAL MEMBERS AND RELATED METHODS AND SYSTEMS

(71) Applicant: BRIGHAM YOUNG UNIVERSITY, Provo, UT (US)

(72) Inventor: Paul William Richards, Orem, UT (US)

(73) Assignee: BRIGHAM YOUNG UNIVERSITY, Provo, UT (US)

( * ) Notice: Subject to any disclaimer, the term of this patent is extended or adjusted under 35 U.S.C. 154(b) by 0 days.

(21) Appl. No.: 14/509,822

(22) Filed: Oct. 8, 2014

(65) Prior Publication Data

US 2015/0096244 A1 Apr. 9, 2015

Related U.S. Application Data

(60) Provisional application No. 61/888,568, filed on Oct. 9, 2013, provisional application No. 61/952,423, filed on Mar. 13, 2014.

(51) Int. Cl.

| | |
|---|---|
| ***E04H 12/00*** | (2006.01) |
| ***E04B 1/98*** | (2006.01) |
| ***E04C 3/02*** | (2006.01) |
| ***E04C 3/04*** | (2006.01) |
| ***E04C 3/08*** | (2006.01) |
| ***E04C 3/06*** | (2006.01) |
| ***E04C 3/40*** | (2006.01) |

(52) U.S. Cl.

CPC ... *E04B 1/98* (2013.01); *E04C 3/02* (2013.01); *E04C 3/04* (2013.01); *E04C 3/06* (2013.01); *E04C 3/083* (2013.01); *E04C 3/40* (2013.01); *E04C 2003/043* (2013.01); *E04C 2003/0413* (2013.01); *E04C 2003/0434* (2013.01); *E04C 2003/0452* (2013.01); *E04C 2003/0465* (2013.01); *E04C 2003/0473* (2013.01)

(58) Field of Classification Search

CPC ..... E04B 1/19; E04B 1/98; E04H 9/02; E04C 3/02; E04C 3/04; E04C 3/083

USPC ..... 52/481.1, 831, 843, 846, 838, 650.1, 52/650.2, 636, 653.2

See application file for complete search history.

(56) References Cited

U.S. PATENT DOCUMENTS

| | | | | |
|---|---|---|---|---|
| 3,039,414 A | | 6/1962 | Rosanes | |
| 3,965,631 A | * | 6/1976 | Sauer | 52/232 |
| 4,598,514 A | * | 7/1986 | Shirey | 52/232 |

(Continued)

FOREIGN PATENT DOCUMENTS

| | | |
|---|---|---|
| EP | 1067250 | 1/2001 |
| GB | 1319623 | 6/1973 |

(Continued)

OTHER PUBLICATIONS

U.S. Appl. No. 61/888,568, filed Oct. 9, 2013, Richards.

(Continued)

*Primary Examiner* — Beth Stephan

(74) *Attorney, Agent, or Firm* — Dorsey & Whitney LLP

(57) ABSTRACT

Embodiments disclosed herein relate to structural, seismic beams and columns as well as to structures including such beams and columns. The seismic beams and columns may be sized, shaped, or otherwise configured to produce approximately even or uniform load distribution (e.g., during a seismic event and/or wind loading event).

18 Claims, 8 Drawing Sheets

(56) References Cited

U.S. PATENT DOCUMENTS

| | | | | |
|---|---|---|---|---|
| 4,606,166 | A * | 8/1986 | Platt et al. | 52/664 |
| 5,678,375 | A * | 10/1997 | Juola | 52/655.1 |
| 5,680,738 | A * | 10/1997 | Allen et al. | 52/837 |
| 6,073,405 | A * | 6/2000 | Kasai et al. | 52/283 |
| 2003/0208985 | A1* | 11/2003 | Allen et al. | 52/653.1 |
| 2006/0110220 | A1* | 5/2006 | Cable et al. | 405/254 |
| 2008/0072527 | A1* | 3/2008 | Kondo et al. | 52/729.1 |
| 2009/0272063 | A1* | 11/2009 | Siu | 52/650.3 |

FOREIGN PATENT DOCUMENTS

| | | | | |
|---|---|---|---|---|
| JP | 09125515 | A * | 5/1997 | E04B 1/24 |
| JP | 2000248685 | | 9/2000 | |
| JP | 2004027840 | | 1/2004 | |
| JP | 2006002505 | | 1/2006 | |
| KR | 200363068 | | 9/2004 | |
| KR | 20140115894 | | 10/2014 | |

OTHER PUBLICATIONS

U.S. Appl. No. 61/952,423, filed Mar. 13, 2014, Richards.

Cordova et al. "Steel Connections: Proprietary or Public Domain?" Modern Steel Constructions, 7 pages. (Oct. 2011).

Engelhardt et al. "Reinforcing of steel moment connections with cover plates: benefits and limitations" Engineering Structures, vol. 20, Nos. 4-6, pp. 510-520 (1998).

International Search Report and Written Opinion from International Application No. PCT/US2014/059745 mailed Jan. 13, 2015.

* cited by examiner

STRUCTURAL MEMBERS AND RELATED METHODS AND SYSTEMS

CROSS-REFERENCE TO RELATED APPLICATIONS

This applications claims priority to U.S. Provisional Application No. 61/888,568 filed on 9 Oct. 2013 and to U.S. Provisional Application No. 61/952,423 filed on 13 Mar. 2014, the disclosures of each of the foregoing applications are incorporated herein, in their entireties, by this reference.

BACKGROUND

Structural systems, (e.g., buildings and similar structures) commonly include interconnected structural members, such as beams and columns. For example, structural beams and columns may form general support and/or frames of a building and may secure one or more building components, such as walls, floors, roof, etc. During a seismic event, the structural members of the building may experience loads that may lead to failure thereof. Furthermore, in some systems, structural fuses may absorb energy imparted onto the structure by the seismic event and may dissipate such energy (e.g., through failure thereof). Failure of such structural fuses, however, may require repair and/or replacement thereof.

Buildings may be configured to resist lateral forces (e.g., from seismic events) by including beams and columns which typically inefficiently absorb the energy imparted into the building by such forces. As such, in some instances, a seismic event may damage the structural members and/or other components of the building. Generally, damaged or failed structural components may require costly repair and/or replacement.

Accordingly, users and manufacturers of structural members and systems continue to seek improvements of such structural members and systems to minimize or eliminate damage thereto from seismic events.

SUMMARY

Embodiments disclosed herein relate to structural, seismic beams and columns as well as to structures including such seismic beams and columns. In some embodiments, the seismic beams and columns may be sized, shaped, or otherwise configured to have an approximately even or uniform stress distribution (e.g., during a seismic event and/or wind loading event). For instance, the seismic beams and/or columns may form or may be included in a moment-resisting frame, which may resist lateral forces. In particularly, the moment-resisting frame may have rigid joints or connections between the seismic beams and columns, such that lateral force applied to the moment-resisting frame produces bending moment and/or shear forces in the seismic beams and columns and/or at joints therebetween.

In at least one embodiment, a seismic beam for fabrication of a moment-resisting frame is disclosed. The seismic beam includes one or more webs extending along a longitudinal axis and a plurality of flanges connected to the one or more webs and extending along the longitudinal axis. At least one flange of the plurality of flanges is positioned on a first side of the one or more webs, and at least another flange of the plurality of flanges is positioned on a second, opposite side of the one or more webs. Each flange of the plurality of flanges has an approximately planar major side that is oriented approximately perpendicular to the one or more webs. Moreover, each major side has a width that gradually decreases along the longitudinal axis from a first location to a second location.

In at least one embodiment, a moment-resisting frame is disclosed. The moment-resisting frame includes a first vertical beam and a second vertical beam oriented approximately parallel to the first vertical beam. The moment-resisting frame also includes a first horizontal beam rigidly connected at a first end thereof to a connection location on the first beam and at a second end thereof to a connection location on the second beam. The first horizontal beam includes a first web having approximately vertical orientation and a first flange connected to the first web. The first flange has an approximately horizontal orientation. The first flange also has a greater width at or near the first end than at an intermediate location between the first end and the second end. The first horizontal beam also includes a second flange connected to the first web and having an approximately horizontal orientation.

Additional or alternative embodiments include a moment-resisting frame that includes a first vertical beam, a second vertical beam, and a first horizontal beam rigidly connected at a first end thereof to a connection location on the first beam and at a second end thereof to a connection location on the second beam. Furthermore, one or more of the first vertical beam, second vertical beam, or the first horizontal beam have a varying moment of inertia that decreases along longitudinal axes thereof from a first location to a second location.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Figure 1:
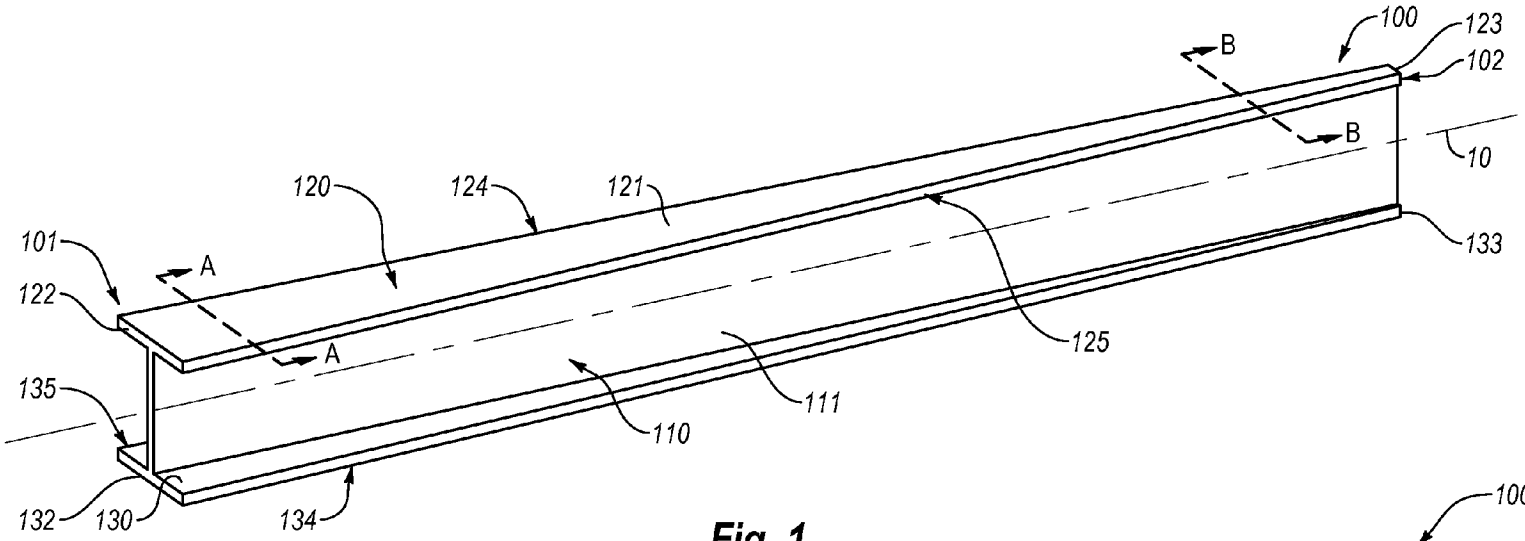
FIG. 1 is an isometric view of a seismic beam according to an embodiment.

Embodiments disclosed herein relate to structural, seismic beams and columns as well as to structures including such seismic beams and columns. In some embodiments, the seismic beams and columns may be sized, shaped, or otherwise configured to have an approximately even or uniform stress distribution (e.g., during a seismic and/or wind loading event). For instance, the seismic beams and/or columns may form or may be included in a moment-resisting frame, which resist lateral forces. In particular, the moment-resisting frame may have rigid joints or connections between the seismic beams and columns, such that lateral force applied to the moment-resisting frame produces bending moment and/or shear forces in the seismic beams and columns and/or at joints therebetween.

A typical moment-resisting frame includes conventional beams and columns that have an approximately uniform cross-section along respective lengths thereof. Also, generally, the bending moment experienced by the seismic beams and/or columns, which is produced by application of lateral force to the moment-resisting frame, produces stress in the seismic beams and columns of the moment-resisting frame. In some embodiments, the seismic beams and/or columns described herein may be sized, shaped, or otherwise configured to have an approximately even or uniform distribution of stresses related to bending moments experienced thereby (e.g., along a length or longitudinal axis thereof). Accordingly, to form the moment-resisting frame designed or capable of resisting particular lateral forces, in some embodiments, the seismic beams and/or columns (described below in more detail) may use less material than conventional beams and/or columns.

As described above, the moment-resisting frame may include rigid joints. While the rigid joint may vary from one embodiment to the next, generally, a rigid joint rigidly or substantially inflexibly restrains relative movement (e.g., pivoting) between the beams and/or columns connected at such joints. For example, a rigid joint between a beam and a column may be a welded joint. In some instances, lateral forces applied to the moment-resisting frame may damage or fail one or more rigid joints (e.g., welds) of the moment-resisting frame, thereby compromising integrity thereof as well as integrity of a structure (e.g., a building) reinforced by the moment-resisting frame. In conventional practice, the moment-resisting frame may include preferentially weakened point(s) or location(s) along beams and/or columns (e.g., a Reduced Beam Section (RBS)), which may be near the rigid joints and may allow such beams and/or columns to plastically deform at such preferentially weakened points, thereby reducing the risk of failure at the rigid joints. In some embodiments, distributing the stress along the seismic beams and/or columns of the moment-resisting frame may reduce the risk of joint failure. As such, the moment-resisting frame according to one or more embodiments may include seismic beams and/or columns without preferentially weakened locations that may lead to costly repairs or in irreparable damage after application of lateral forces to the moment-resisting frame (e.g., during a seismic event and/or wind loading event).

FIG. 1 illustrates a seismic beam 100 according to at least one embodiment. The seismic beam 100 may have a generally I-shaped cross-section. For instance, the seismic beam 100 may include a web 110 and flanges 120, 130 connected to (e.g., attached to or integrated with) the web 110. The web 110 and the flanges 120, 130 may extend longitudinally along a longitudinal axis 10 and may define a length of the seismic beam 100. It should be appreciated that term "seismic beam" is used for ease of description and is not intended to connote a particular orientation (e.g., vertical, horizontal, etc.). Hence, for example, depending on a particular application or structure, the seismic beam 100 may be incorporated as a beam, a column, or any other structural member, which may have horizontal, vertical, or any other suitable orientation.

In some embodiments, the web 110 and/or the flanges 120, 130 may have approximately planar major surfaces. For instance, the web 110 may have an approximately planar major surface 111. Similarly, the flange 120 may have an approximately planar major surface 121. It should be appreciated that the flange 130 may be similar to or the same as the flange 120. Hence, in some embodiments, the flange 130 may have an approximately planar major surface that may be similar to or the same as the major surface 121 of the flange 120.

In an embodiment, the major surfaces of the web 110 (e.g., major surface 111 and an opposing major surface) may be approximately perpendicular to one or more major surface of the flange 120 and/or flange 130 (e.g., to the major surface 121). Accordingly, as described above, in at least one embodiment, the seismic beam 100 may have a generally I-shaped cross-section. It should be appreciated, however, that at least some portions of the major surfaces of the web 110 and/or of any of the flanges 120, 130 may have non-planar configuration (e.g., irregular, bowed or curved, etc.). Moreover, in some embodiments, the seismic beam 100 may have a generally I-shaped cross-section and generally non-planar major surfaces of one or more of the web 110 and/or one or more of the flanges 120, 130.

The cross-sectional area of the seismic beam 100 may change or vary along the longitudinal axis 10. For example, the cross-sectional area (e.g., taken at cross-section A-A) of the seismic beam 100 may decrease from a first area at or near a first end 101 of the seismic beam 100 to a second area (e.g., taken at cross-section B-B) at or near a second end 102 of the seismic beam 100. Particularly, the cross-sectional area of the seismic beam 100 at a given location may the sum of the cross-sectional areas of the web 110 and the cross-sectional areas of the flanges 120, 130 at the given location. Accordingly, the variance (e.g., decrease) of the cross-sectional area of the seismic beam 100 along the longitudinal axis 10 may be produced by varying the cross-sectional areas of one or more of the web 110, flange 120, or flange 130 along the longitudinal axis 10.

For instance, generally reducing the cross-sectional areas of the flange 120 and/or flange 130 along the longitudinal axis 10 may produce reduction of the total cross-sectional area of the seismic beam 100 along the longitudinal axis 10 thereof. In an embodiment, the cross-sectional areas of the flange 120 and/or flange 130 may vary linearly along the longitudinal axis 10. In some embodiments, the cross-sectional areas of the flange 120 and/or flange 130 may have nonlinear variance along the longitudinal axis 10. It should be appreciated that varying (e.g., reducing) the cross-sectional area of the seismic beam 100 along the longitudinal axis 10 thereof may result in correspondingly varied (e.g., reduced or increased) moments of inertia ($I_x$, $I_y$) of the seismic beam 100 at various locations along the longitudinal axis 10. Moreover, linear variance of the cross-sectional area of the seismic beam 100 may result in nonlinear variance of one or more moments of inertia (i.e., of the $I_x$ and/or $I_y$). In some embodiments, nonlinear variance of the cross-sectional area of the seismic beam 100 may result in linear variance of one or more moments of inertia of seismic beam 100.

In at least one embodiment, the flange 120 and/or flange 130 may be generally tapered, having a greater width at the first end 101 and narrowing toward a smaller width at the second end 102. For example, the flange 120 and/or flange 130 may have respective base sides 122, 132 at or near the first end 101 and tapered sides 123, 133 at or near the second end 102. In other words, respective widths of the flanges 120, 130 may progressively or gradually shorten along the longitudinal axis 10 from the first end 101 toward the second end 102 of the seismic beam 100. In some embodiments, the reduction of the widths of the flange 120 and/or flange 130 along the longitudinal axis 10 may be approximately linear such that the flange 120 and/or flange 130 have generally triangular shapes (e.g., truncated triangular shapes). As such, in some embodiments, the flange 120 and/or flange 130 may have approximately straight or linear longitudinal sides 124, 125 and 134, 135, respectively.

Furthermore, linear reduction in widths of the flange 120 and/or flange 130 may linearly reduce the cross-sectional areas of the seismic beam 100 along the longitudinal axis 10 from the first end 101 toward the second end 102. Alternatively, the reduction in widths may be nonlinear (e.g., logarithmic, function of a cube root, irregular, etc.), which may produce nonlinear variance (e.g., reduction) of the cross-sectional area of the seismic beam 100 from the first end 101 toward the second end 102. In some embodiments, the flange 120 and/or flange 130 may have non-linear longitudinal sides (e.g., generally curved or arcuate), which may produce non-linear variance of the respective widths of the flange 120 and flange 130 and cross-sectional areas thereof taken along the longitudinal axis 10. For example, the non-linear longitudinal sides may follow a generally circular path, a generally elliptical path, or a generally parabolic path. General peripheral shapes of the flange 120 and/or flange 130 (as defined by respective longitudinal sides, base side, and tapered side thereof) may vary from one embodiment to the next. In any event, however, the longitudinal sides of the flange 120 and/or flange 130 may vary in a manner that produces reduction in the respective widths of the flange 120 and/or flange 130 from the first end 101 toward the second end 102 of the seismic beam 100.

As mentioned above, in some embodiments, the seismic beam 100 may be included in various structures, such as moment-resisting frames. Moreover, in some instances, moments experienced by the seismic beam 100 may vary along the longitudinal axis 10 thereof. In an embodiment, the moments of inertia $I_x$ and/or $I_y$ may generally vary in a similar manner as the moment experienced by the seismic beam 100. In other words, the moments of inertia $I_x$ and/or $I_y$ of the seismic beam 100 may be sufficient to compensate or counteract corresponding moments along the longitudinal axis 10 may (e.g., in a manner that substantially evenly distributes stress in along the longitudinal axis of the seismic beam 100 and/or avoids, limits, and/or more evenly plastic deformation of the seismic beam 100).

For example, the moment experienced by the seismic beam 100 during seismic loading may be highest at the first end 101 and lowest at the second end 102. Hence, the moments of inertia $I_x$ and/or $I_y$ of the seismic beam 100 may be highest at the first end 101 and lowest at the second end 102 of the seismic beam 100 in order to effectively lower and/or more evenly distribute bending stresses caused by the moment. In an embodiment, as described above, the seismic beam 100 may include generally tapered flanges 120, 130, such that the moment of inertia $I_y$ of the seismic beam 100 is highest at the first end 101 and lowest at the second end 102. Accordingly, the seismic beam 100 may have a more efficient or more cost effective distribution material along the longitudinal axis 10 (e.g., as compared with a conventional beam that has approximately constant cross-sectional areas of the flanges and/or of the web along the length thereof).

Generally, the seismic beam 100 may be made from any number of suitable materials. For example, the seismic beam 100 may comprise steel (e.g., rolled steel having tensile strength of about 50 ksi), an aluminum alloy, etc. In some embodiments, the web 110 as well as the flanges 120, 130 may comprise the same or similar material. Alternatively, as described below in more detail, the web 110, flange 120, or flange 130 may comprise materials that are different one from another. In any event, distribution of the material along the longitudinal axis 10 of the seismic beam 100 may be such that more material and/or higher yield strength material is located at locations that are intended to experience higher moment and less material is located at locations that are intended to experience lower moment (e.g., during a seismic event and/or wind loading event).

In some embodiments, the seismic beam 100 may be fabricated from a conventional I-beam or H-beam. For example, portions of the flanges of a conventional beam may be removed or cut away to produce the flanges 120, 130. Alternatively, in some embodiments, the flanges 120, 130 may be welded or otherwise secured to the web 110.

Figure 2:
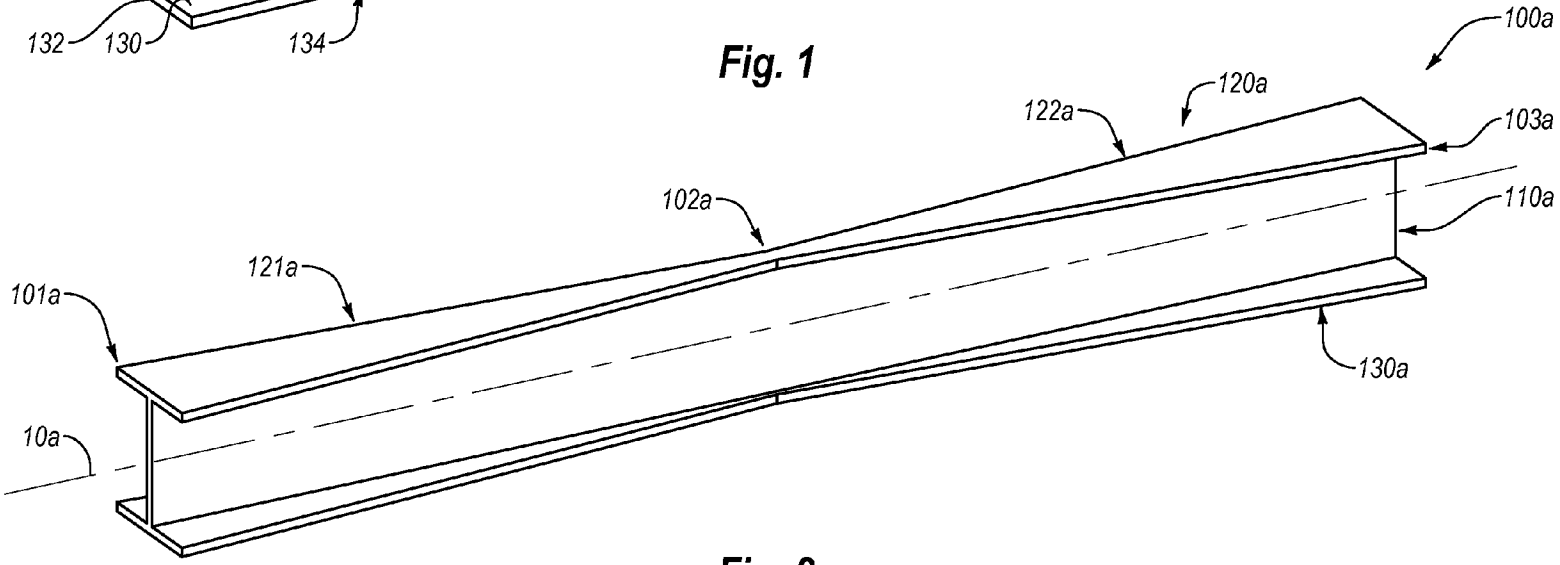
FIG. 2 is an isometric view of a seismic beam according to another embodiment.

As described above, the seismic beam may have varying moment of inertia along longitudinal axis or length thereof (e.g., moments of inertia may vary to approximately match anticipated moments experienced thereby). In some embodiments, the seismic beam may experience load or moment having alternating direction along (e.g., along longitudinal axis of the seismic beam), such that a portion or location of the seismic beam experiences no moment thereon. FIG. 2 illustrates seismic beam **100*a* according to an embodiment that may be included in a system or structure where under some loads, the seismic beam 100*a* may experience no moment at or near a center thereof (as measure along longitudinal axis 10*a*). Except as otherwise described herein the seismic beam 100*a* and its elements or components may be similar to or the same as seismic beam 100 (FIG. 1) and its corresponding elements and components. For instance, the seismic beam 100*a* may include a web 110*a* and opposing flanges 120*a* and 130*a***.

In at least one embodiment, the moment of inertia of the seismic beam **100*a* may alternatingly decrease and increase along the longitudinal axis 10*a*. For example, moment of inertia may decrease from a first location 101*a* on the seismic beam 100*a* to a second location 102*a*, and may increase from the second or intermediate location 102*a* to a third location 103*a* on the seismic beam 100*a*. As such, the seismic beam 100*a* experiencing moment that decreases and increases along the longitudinal axis 10*a* of the seismic beam 100*a*, may proportionally resist such moment. In an embodiment, the second location 102*a* may be approximately midway between the first and second locations 101*a*, 103*a* (e.g., at the center of the seismic beam 100 as measured along the longitudinal axis 10*a***).

As such, in some embodiments, the flange 120*a* and/or the flange 130*a* may have varying cross-sectional shapes along the longitudinal axis 10*a*, which may contribute to varying the moment of inertia of the seismic beam 100*a* in a manner that approximates the moment experienced by the seismic beam 100*a* (e.g., such that the seismic beam 100*a* has a higher moment of inertia at locations experiencing higher moment and lower moment of inertia at locations experiencing lower moment). In at least one embodiment, a cross-sectional area of the flange 120*a* may vary along the longitudinal axis 10*a* such that the cross-sectional area of the flange 120*a* at the first end 101*a* and at the third location 103*a* is greater than at the second location 102*a*. In some embodiments, the second location 102*a* may be located between the first location 101*a* and the third location 103*a* along the longitudinal axis 10*a*.

For instance, the flange 120*a* may have approximately first and second flange portions 121*a*, 122*a*, which may have bases thereof at or near the respective first location 101*a* and second location 102*a*. In some embodiments, the first and second flange portions 121*a*, 122*a* may be connected together or integrated with each other (e.g., without a gap there between). For example, the first flange portion 121*a* and/or the second flange portion 122*a* may be similar to the flange 120 of the seismic beam 100 (FIG. 1). As such, in at least one embodiment, the first flange portion 121*a* and/or the second flange portion 122*a* may have approximately straight or linear sides. Alternatively, the first flange portion 121*a* and/or the second flange portion 122*a* may have nonlinear sides, as described above in connection with the flange 120 of the seismic beam 100 (FIG. 1).

In some embodiments, the flange 130*a* may have an approximately the same shape as the flange 120*a*. Alternatively, the flange 130*a* may have a different shape than the flange 120*a* (e.g., approximately uniform shape, a different shape having varying width, etc.). In any event, varying the widths of the flange 120*a* (e.g., of the first flange portion 121*a* and/or the second flange portion 122*a*) and/or of the flange 130*a* or one or more portions thereof may vary the moment of inertia of the seismic beam 100*a* along the longitudinal axis 10*a* in a manner that approximately corresponds to the variance of the moment experienced by the seismic beam 100*a* along the longitudinal axis 10*a*.

Figure 3:
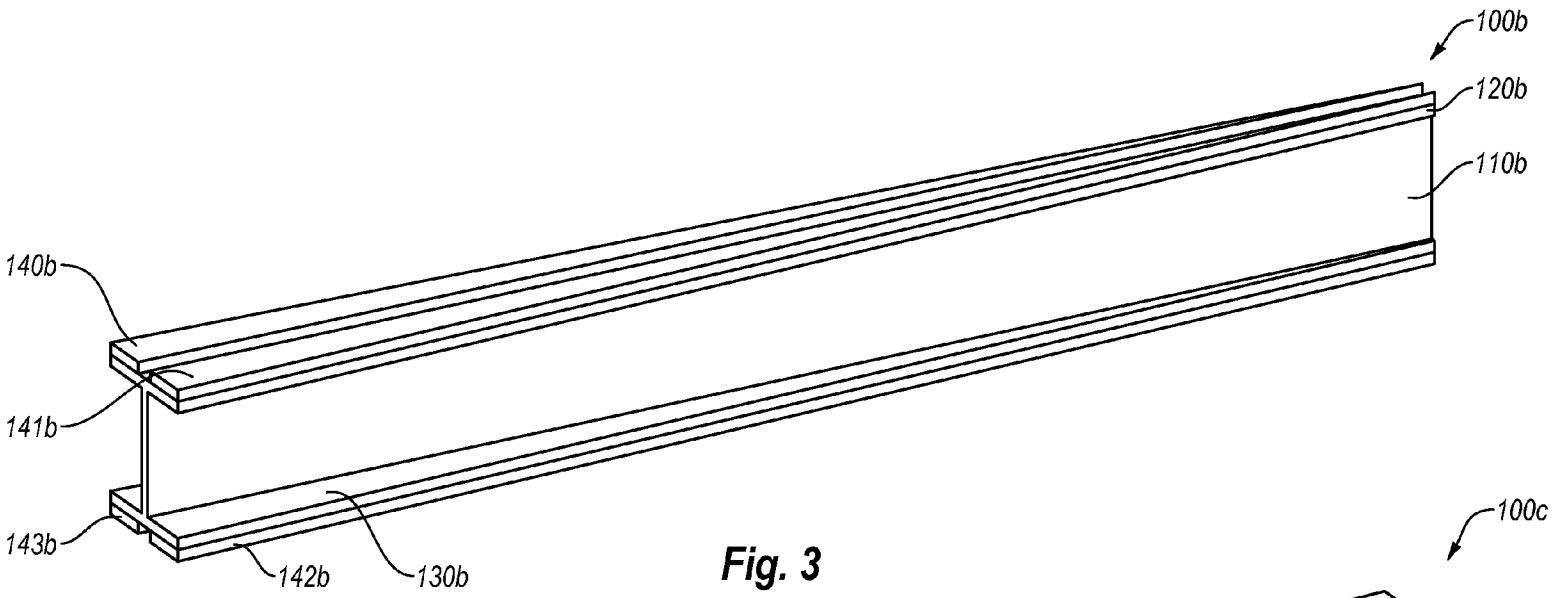
FIG. 3 is an isometric view of a seismic beam according to yet another embodiment.

As described above, the flanges of the seismic beams may be fabricated by removing a portion of an otherwise rectangular flange. Additionally or alternatively, one or more portions or plates may be attached to an existing or a modified flange of a beam. FIG. 3, for example, illustrates a seismic beam 100*b* that includes plates 140*b*, 141*b*, 142*b*, 143*b* that may be attached or secured to flanges 120*b*, 130*b*. Except as otherwise described herein the seismic beam 100*b* and its elements or components may be similar to or the same as any of the seismic beams 100, 100*a* (FIGS. 1, 2) and their corresponding elements and components. For instance, the seismic beam 100*b* may include a web 110*b* connected to the flange 120*b* and flange 130*b* and have a generally similar shape to the seismic beam 100 (FIG. 1).

As mentioned above, the seismic beam 100*b* may be manufactured from steel, aluminum, etc. For example, the web 110*b*, flange 120*b*, and flange 130*b* may be integrated together, while the plates 140*b*, 141*b*, 142*b*, 143*b* may be attached to the respective flanges 120*b* and/or 130*b*. Moreover, in some embodiments, one or more of the plates 140*b*, 141*b*, 142*b*, 143*b* may include different material than the web 110*b*, flange 120*b*, flange 130*b*, or combinations thereof. For instance, the web 110*b* and flanges 120*b*, 130*b* may include material having a first tensile yield strength and the plates 140*b*, 141*b*, 142*b*, 143*b* may include material having a second tensile yield strength, which may be less than or greater than the first tensile strength (e.g., the first tensile yield strength may be 50 ksi and the second tensile yield strength may be 30 ksi, 100 ksi, etc.).

In some embodiments, however, the plates 140*b*, 141*b*, 142*b*, 143*b* may include the same or similar material as the web 110*b* and/or flange 120*b*, 130*b*. Moreover, as described above, fabricating the seismic beam 100*b* may involve removing portions of the rectangular flanges to form the flange 120*b* and/or flange 130*b*. As such, in some instances, removed portions of the original flange(s) may form the plates 140*b*, 141*b*, 142*b*, 143*b*, which may be attached to the flange 120*b* and/or flange 130*b*.

In an embodiment, the plates 140*b*, 141*b*, 142*b*, 143*b* may be smaller than corresponding portions of the flange 120*b* (e.g., portions of the flange 120*b* extending outward from the centerline of the flange 120*b*). Accordingly, in some embodiments, the seismic beam 100*b* may include a gap or space between the plates 140*b*, 141*b* and between the plates 142*b*, 143*b*. Alternatively, however, at least some of the adjacent plates 140*b*, 141*b*, 142*b*, 143*b* may abut one another such that minimizes or substantially eliminate space therebetween. Moreover, in some examples, the in lieu of or in addition to the adjacent plates 140*b*, 141*b* and/or plates 142*b*, 143*b*, the seismic beam may include a single plate that may cover a corresponding portion of or the entire flange 120*b* and/or flange 130*b*, as described below.

Figure 4:
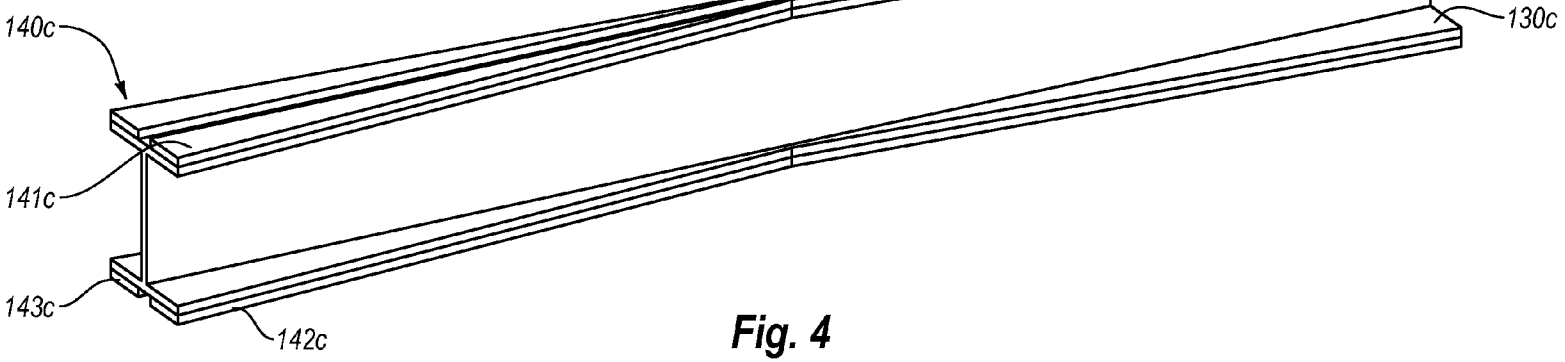
FIG. 4 is an isometric view of a seismic beam according to still one or more other embodiments.

FIG. 4 illustrates a seismic beam 100*c* that has varying moment of inertia along the longitudinal axis thereof, according to an embodiment. Except as otherwise described herein the seismic beam 100*c* and its elements or components may be similar to or the same as any of the seismic beams 100, 100*a*, 100*b* (FIGS. 1-3) and their corresponding elements and components. For instance, the seismic beam 100*c* may include flange 120*c* and flange 130*c* connected to a web 110*c*, and may generally have generally the same or similar shape as the seismic beam 100*a* (FIG. 2).

In at least one embodiment, the seismic beam 100*c* may include plates 140*c*, 141*c*, 142*c*, 143*c* attached to the flange 120*c* and/or flange 130*c*. As described above, the plates 140*c*, 141*c*, 142*c*, 143*c* may be formed from the portions removed from flanges of an otherwise rectangular or conventional I-beam or H-beam to form the flange 120*c* and/or flange 130*c*. In some embodiments, each of the plates 140*c*, 141*c*, 142*c*, 143*c* may be continuous or discrete plate that expands from a first end of the seismic beam 100*c* to a second, opposing end thereof. Alternatively, at least some of the plates 140*c*, 141*c*, 142*c*, 143*c* may include multiple (e.g., two or more) portions.

Moreover, as mentioned above, any of the plates 140*c*, 141*c*, 142*c*, 143*c* or portions thereof may include the same material as the web 110, flange 120, flange 130, or combinations thereof (FIG. 1), or may include material different therefrom. In any event, the plates 140*c*, 141*c*, 142*c*, 143*c* may be attached to the respective flanges 120*c* and/or 130*c* to form the seismic beam 100*c* that has varying moment of inertia along the longitudinal axis thereof. Generally, as described above, the plates 140*c*, 141*c*, 142*c*, 143*c* may be attached to the respective flanges 120*c* and/or 130*c* with any number suitable mechanisms (e.g., fasteners, welding, etc.).

Figure 5:
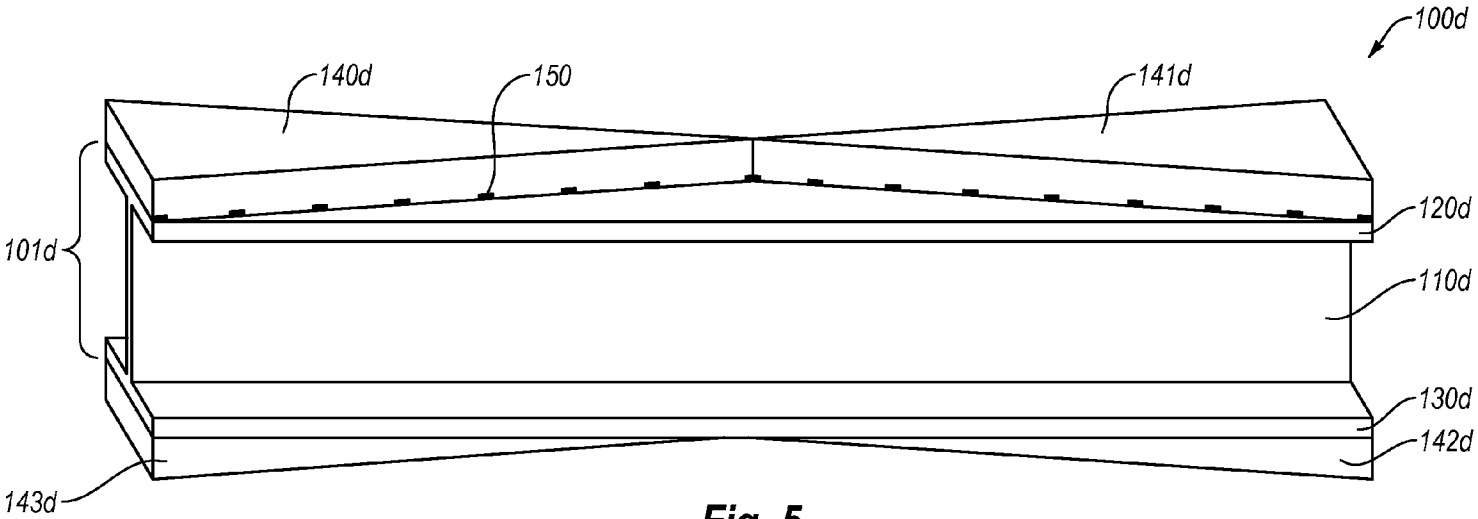
FIG. 5 is an isometric view of a seismic beam according to yet one other embodiment.

In some embodiments, one or more plates may be attached to a conventional I-beam or H-beam to produce varying moment of inertia along the length or longitudinal axis thereof. FIG. 5 illustrates a seismic beam 100*d* that may include a conventional H-beam 101*d* and plates 140*d*, 141*d*, 142*d*, 143*d*, attached to flanges 120*d*, 130*d* of the conventional H-beam 101*d*, according to an embodiment. Except as otherwise described herein the seismic beam 100*d* and its elements or components may be similar to or the same as any of the seismic beams 100, 100*a*, 100*b*, 100*c* (FIGS. 1-4) and their corresponding elements and components. For instance, the seismic beam 100*c* may include the flange 120*c* and flange 130*c* connected together by a web 110*c* and collectively forming the conventional H-beam.

As mentioned above, the seismic beam 100*d* may have varying moment of inertia along the longitudinal axis. More specifically, cross-sectional areas of the plates 140*d*, 141*d*, 142*d*, 143*d* along the longitudinal axis may contribute to the moment of inertia of the seismic beam 100*d* in a manner that the moment of inertia varies along the longitudinal axis to accommodate varying moment experienced by the seismic beam 100*d* at an installation.

It should be appreciated that, generally, the plates 140*d*, 141*d*, 142*d*, 143*d* may be attached to the flange 120*d* and/or flange 130*d* in any suitable manner and with any suitable mechanisms. For instance, the plates 140*d*, 141*d*, 142*d*, 143*d* may be fastened, welded (seam welded, spot welded, brazed, etc.), or otherwise secured to the flange 120*b* and/or flange 130*b*. In an embodiment, at least some of the plates 140*d*, 141*d*, 142*d*, 143*d* may include stich welds 150*d* that may secure the plates 140*d*, 141*d*, 142*d*, 143*d* to the respective flange 120*d* and/or flange 130*d*.

Figure 6:
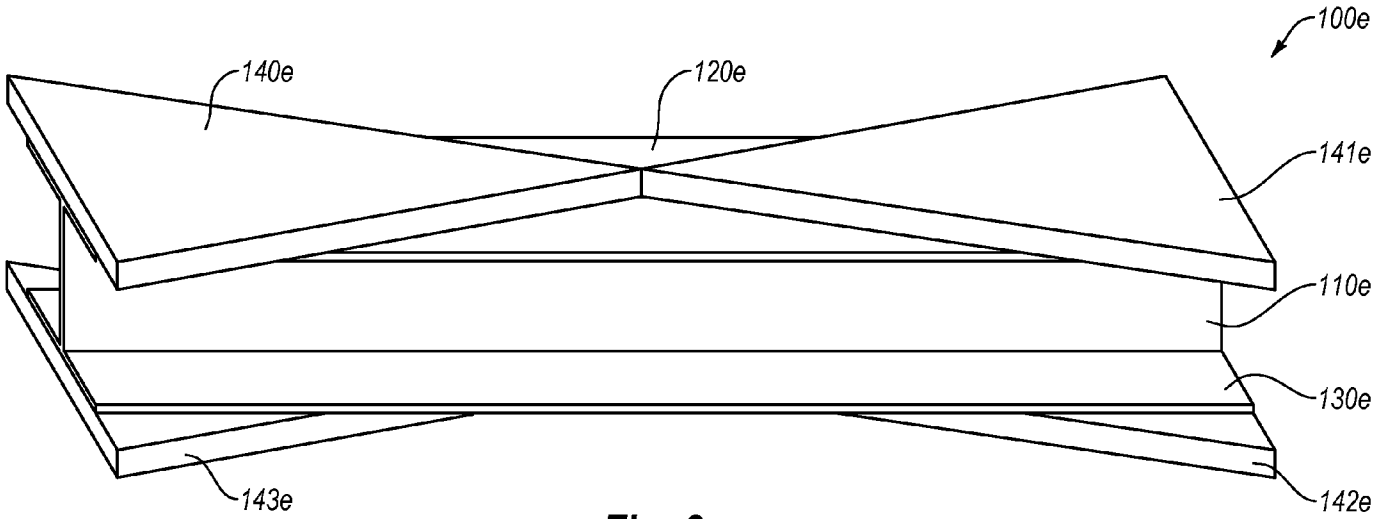
FIG. 6 is an isometric view of a seismic beam according to yet another embodiment.

In some embodiments, outer edges of the plates 140*d*, 141*d*, 142*d*, 143*d* may be within a general lateral perimeter for the flange 120*d* and/or flange 130*d*. Alternatively, however, as shown in FIG. 6, according to an embodiment, a seismic beam 100*e* may include plates 140*e*, 141*e*, 142*e*, 143*e* attached to flange 120*e* and/or flange 130*e*. Except as otherwise described herein the seismic beam 100*e* and its elements or components may be similar to or the same as any of the seismic beams 100, 100*a*, 100*b*, 100*c*, 100*d* (FIGS. 1-5) and their corresponding elements and components. For instance, the seismic beam 100*e* may include a web 110*e* connecting together the flange 120*e* and flange 130*e* (e.g., similar to the seismic beam 100*d* (FIG. 5)). In one or more embodiments, at least some portions of one or more of the plates 140*e*, 141*e*, 142*e*, 143*e* may be wider than the flange 120*e* and/or flange 130*e*. In other words, at least some portions of the plates 140*e*, 141*e*, 142*e*, 143*e* may protrude outward past the perimeter of the flange 120*e* and/or flange 130*e*.

Figure 7:
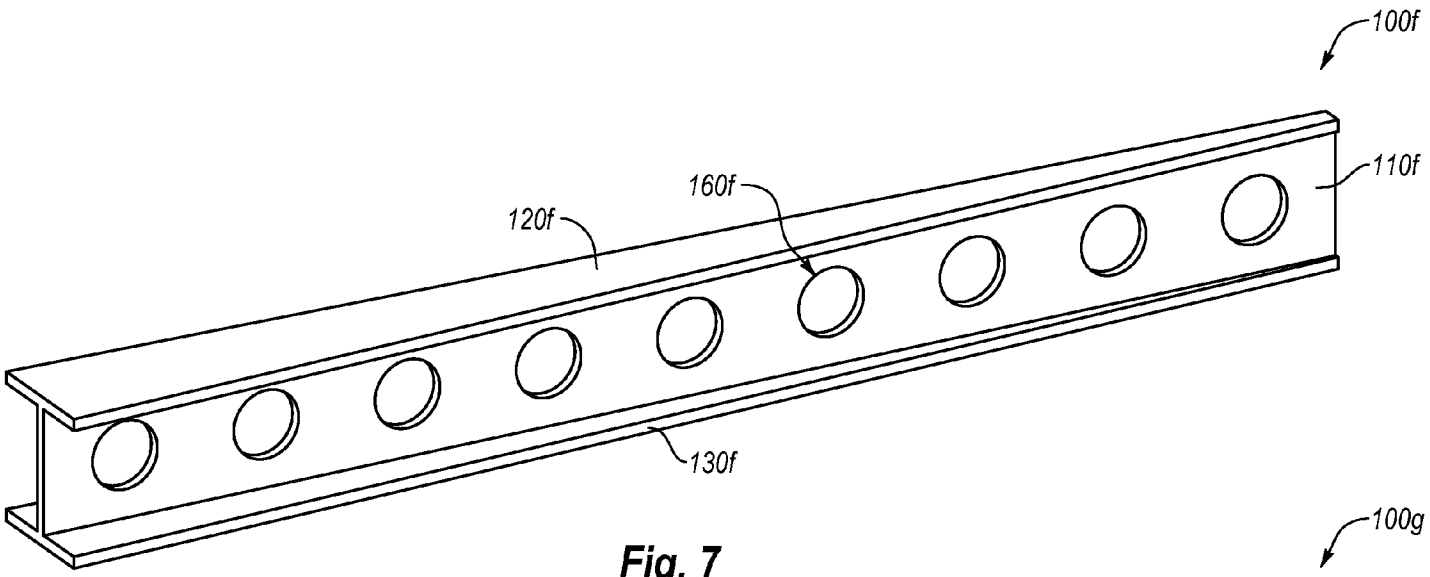
FIG. 7 is an isometric view of a seismic beam according to still another embodiment.

In some embodiments, the seismic beams may include one or more openings or cutouts in the webs thereof. FIG. 7 illustrates a seismic beam 100*f* that include approximately cutouts 160*f* in a web 110*f*, according to an embodiment. For instance, material removed from the web 110*f* (when forming the cutouts 160*f*) may be reused or recycled, thereby reducing material cost of the seismic beam 100*f*. Generally, the cutouts 160*f* may be equidistantly spaced one form another along the longitudinal axis of the seismic beam 100*f*. Alternatively, however, spacing from one to another of the cutouts 160*f* may vary along the seismic beam 100*f*.

Figure 8:
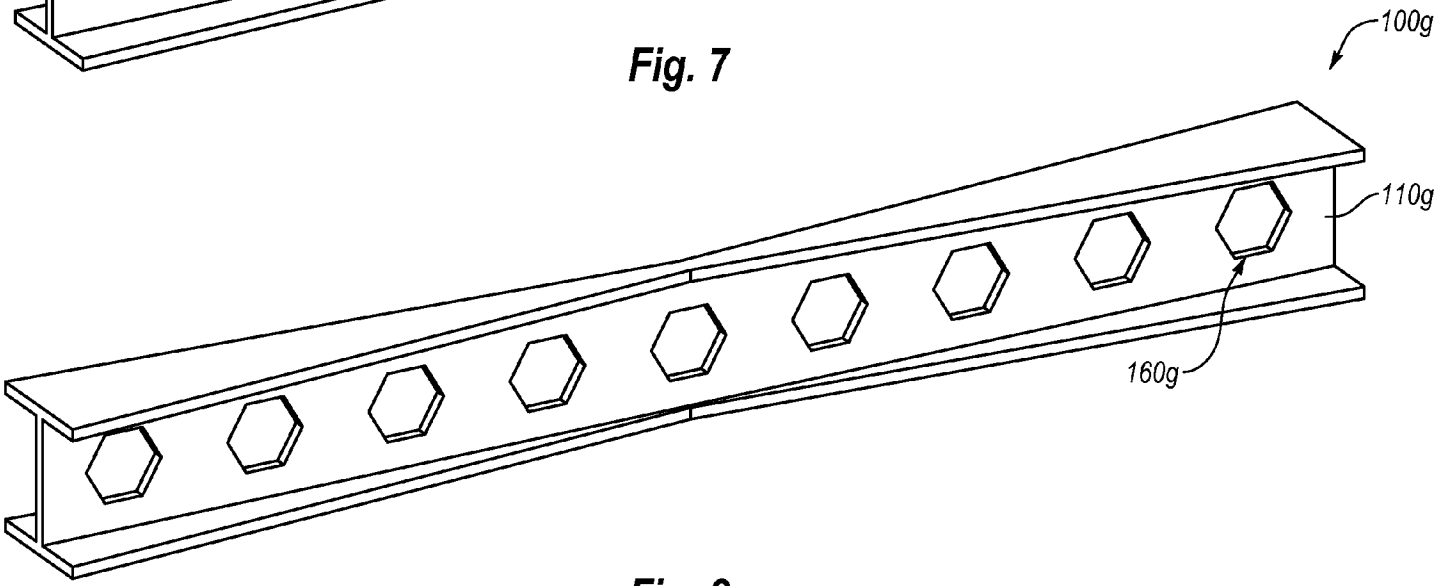
FIG. 8 is an isometric view of a seismic beam according to at least one other embodiment.

In some embodiments, the cutouts 160*f* may be approximately circular. Hence, for instance, the cutouts 160*f* may be machined with one or more rotary tools. In alternative or additional embodiments, as shown in FIG. 8, a seismic beam 100*g* may include a non-circular cutouts 160*g* in a web 110*g* of the seismic beam 100*g*. It should be appreciated that specific shapes, size, spacing, and number of the cutouts may vary from one embodiment to the next. Moreover, any of the seismic beams 100*a-e* described above may include one or more cutouts in the respective webs thereof, which may be similar to the cutouts 160*f* (FIG. 7) and/or cutouts 160*g*.

Figure 9:
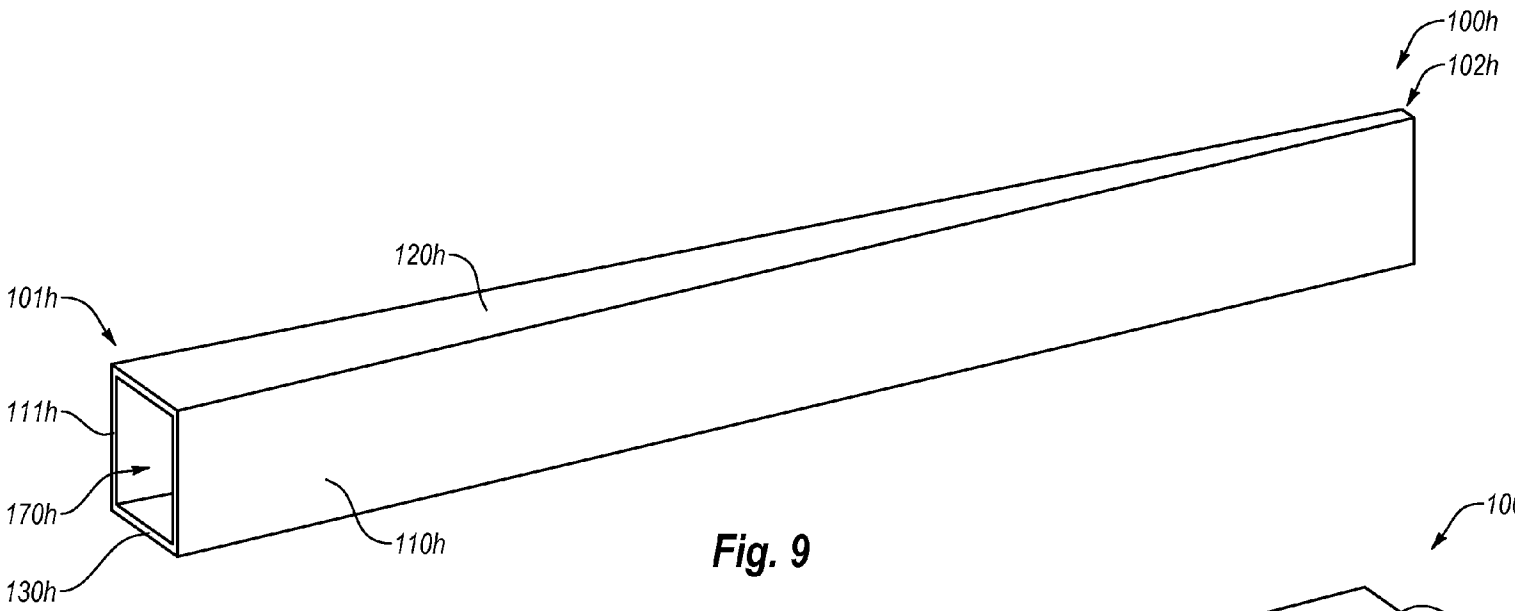
FIG. 9 is an isometric view of a seismic beam according to yet one other embodiment.

While, as described above, in some embodiments, seismic beams and/or columns may include a single web that secures opposing flanges, in additional or alternative embodiments, seismic beams and/or columns may include multiple webs that secure opposing flanges. FIG. 9 illustrates a seismic beam 100*h* that includes webs 110*h*, 111*h* connecting opposing flanges 120*h*, 130*h*, which may generally have a tubular shape, according to an embodiment. Except as otherwise described herein the seismic beam 100*h* and its elements or components may be similar to or the same as any of the seismic beams 100, 100*a*, 100*b*, 100*c*, 100*d*, 100*e* (FIGS. 1-6) and their corresponding elements and components. For example, the moment of inertia of the seismic beam 100*h* may vary from a first end 101*h* toward a second end 102*h* of the seismic beam 100*h* (e.g., the moment of inertia at the second end 102*h* may be smaller than at the first end 101*h*).

In one or more embodiments, the web 110*h*, 111*h* and the flange 120*h*, 130*h* may collectively form or define an opening 170*h*, which may extend longitudinally through the seismic beam 100*h*. For instance, the web 110*h* may be approximately parallel to the web 111*h* and perpendicular to the flange 120*h* and flange 130*h*. Hence, the seismic beam 100*h* may have a generally rectangular or square cross-sectional shape. Likewise, the opening 170*h* may have a generally rectangular cross-sectional shape. It should be appreciated, however, that the seismic beam 100*h* and/or the opening 170*h* may have any suitable shape, which may vary from one embodiment to the next (e.g., triangular, polygonal, circular, or other suitable cross-sectional shape).

Similar to the seismic beam 100 (FIG. 1), the flange 120*h* and/or the flange 130*h* may contribute continuously smaller amounts of cross-sectional area along the longitudinal axis of the seismic beam 100*h* from the first end 101*h* toward the second end 102*h*. For example, the flange 120*h* and/or flange 130*h* may be tapered (e.g., generally triangular). In additional or alternative embodiments, the seismic beam 100*h* may have any suitable peripheral shape or taper.

Figure 10:
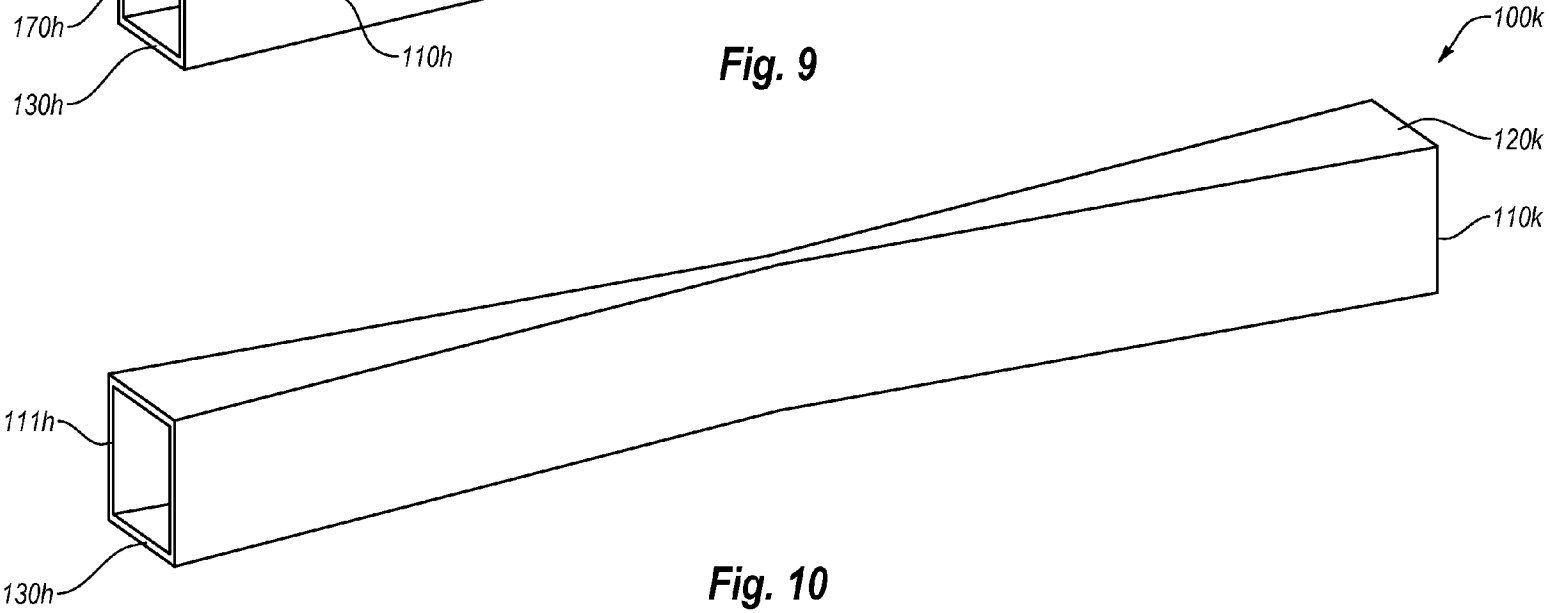
FIG. 10 is an isometric view of a seismic beam according to another embodiment.

While the seismic beam 100*h* includes two webs 110*h* and 111*h* and two flanges 120*h*, 130*h*, it should be appreciated that seismic beams and/or columns may include any number of webs and flanges, which may vary from one embodiment to the next. Hence, as noted above, the cross-sectional shape of the seismic beam and/or column may vary from one embodiment to the next. Moreover, it should be appreciated that any of the seismic beams described above may include multiple webs and/or flanges. For example, FIG. 10 illustrates a seismic beam 100*k* that has an approximately rectangular cross-sectional shape (e.g., similar to the seismic beam 100*h* (FIG. 9) and has alternatingly varying moment of inertia along longitudinal axis (e.g., similar to the seismic beam 100*a* (FIG. 2)). Except as otherwise described herein the seismic beam 100*k* and its elements or components may be similar to or the same as any of the seismic beams 100, 100*a*, 100*b*, 100*c*, 100*d*, 100*e*, 100*h* (FIGS. 1-6, 9) and their corresponding elements and components.

The seismic beam 100*k* and the seismic beam 100*h* (FIG. 9) may be fabricated using any number of suitable manufacturing methods and techniques. For instance, the seismic beam 100*k* may be fabricated by attaching together (e.g., welding) webs 110*k*, 111*k* and flanges 120*k*, 130*k*. Additionally or alternatively, the seismic beam 100*k* may be fabricated by selectively compressing and/or stretching an extruded or folded rectangular tube.

Figure 11:
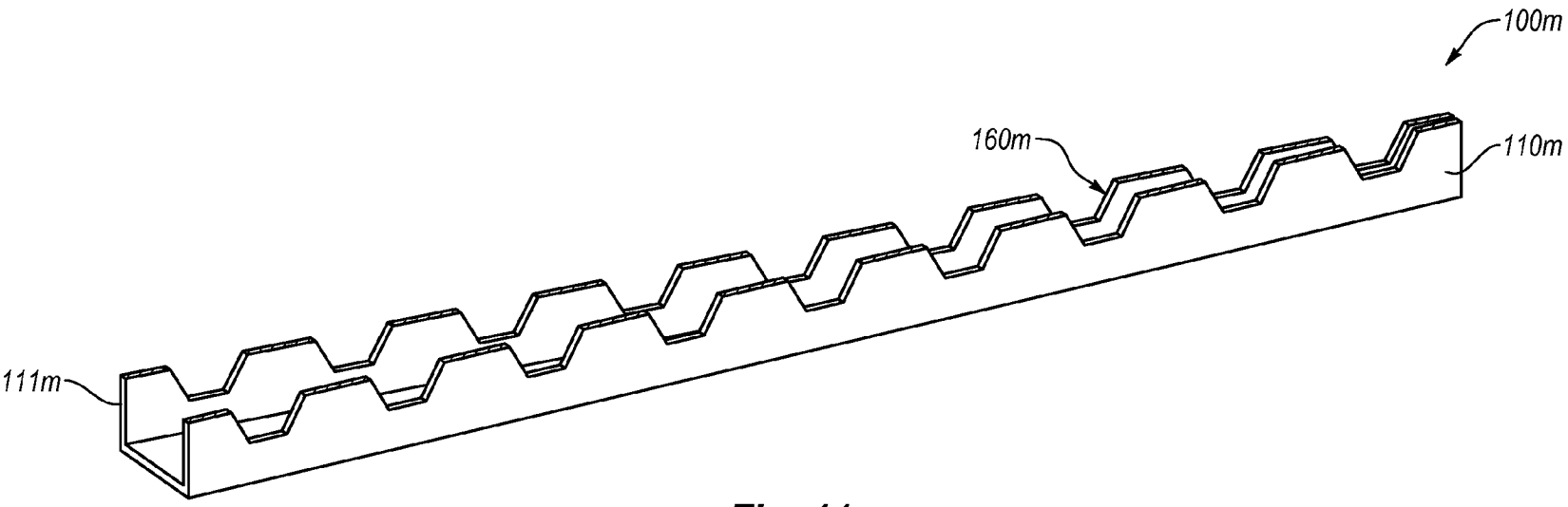
FIG. 11 is a longitudinal cross-sectional, isometric view of the seismic beam shown in FIG. 9, with cutouts formed therein according to an embodiment.
Figure 12:
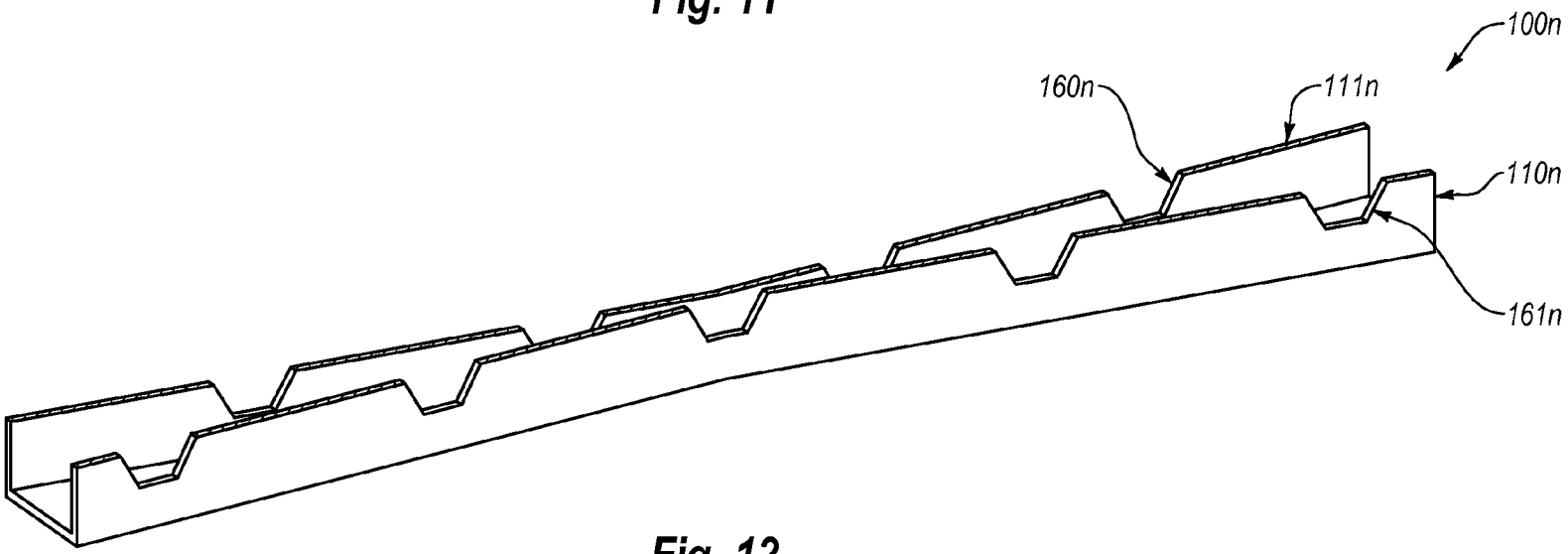
FIG. 12 is a longitudinal cross-sectional, isometric view of the seismic beam shown in FIG. 10, with cutouts formed therein according to an embodiment.

Furthermore, as mentioned above, any of the seismic beams and/or columns described herein may include one or more cutouts in the webs thereof. FIGS. 11-12 illustrate seismic beams seismic beam 100*m*, seismic beam 100*n* with multiple webs, which include multiple openings therein. Except as otherwise described herein the seismic beam 100*m*, seismic beam 100*n* and their elements or components may be similar to or the same as any of the seismic beam 100, seismic beam 100*a*, seismic beam 100*b*, seismic beam 100*c*, seismic beam 100*d*, seismic beam 100*e*, seismic beam 100*h*, seismic beam 100*k* (FIGS. 1-6, 9, 10) and their corresponding elements and components. FIG. 11 illustrates an a seismic beam 100*m* that includes webs 110*m*, 111*m* with polygonal cutouts 160*m* therethrough, according to at least one embodiment.

In at least one embodiment, the seismic beam 100*m* may include cutouts 160*m* that pass through both webs web 110*m* and 111*m*. In other words, the cutouts 160*m* in the web 110*m* may be aligned with the cutouts 160*m* in the web 111*m*, thereby forming openings through the webs 110*m* and 111*m*. Alternatively, as shown in FIG. 12, a seismic beam 100*n* may include cutouts 160*n* in a web 110*n* that are offset along the longitudinal axis of the seismic beam 100*n* from cutouts 161*n* in web 111*n*. In other words, the cutouts 160*n* and 161*n* may be at least partially misaligned one from another along the longitudinal axis of the seismic beam 100*n*. It should be appreciated that, in some examples, one or more of the cutouts in the webs may be aligned with one another, while one or more other cutouts may be misaligned one from another.

Figure 13:
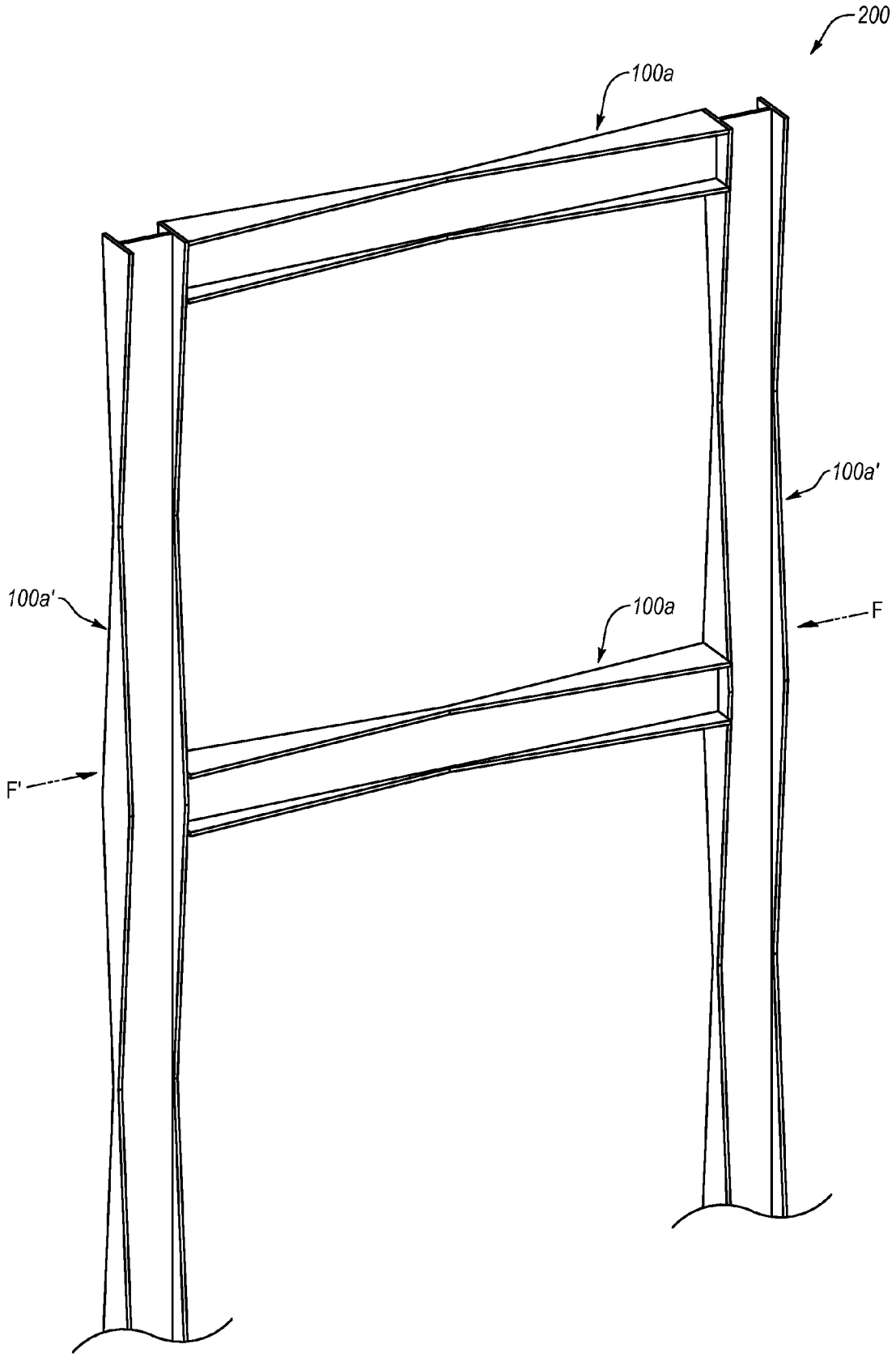
FIG. 13 is an isometric view of a moment resisting frame that includes one or more seismic beams according to an embodiment.
Figure 15:
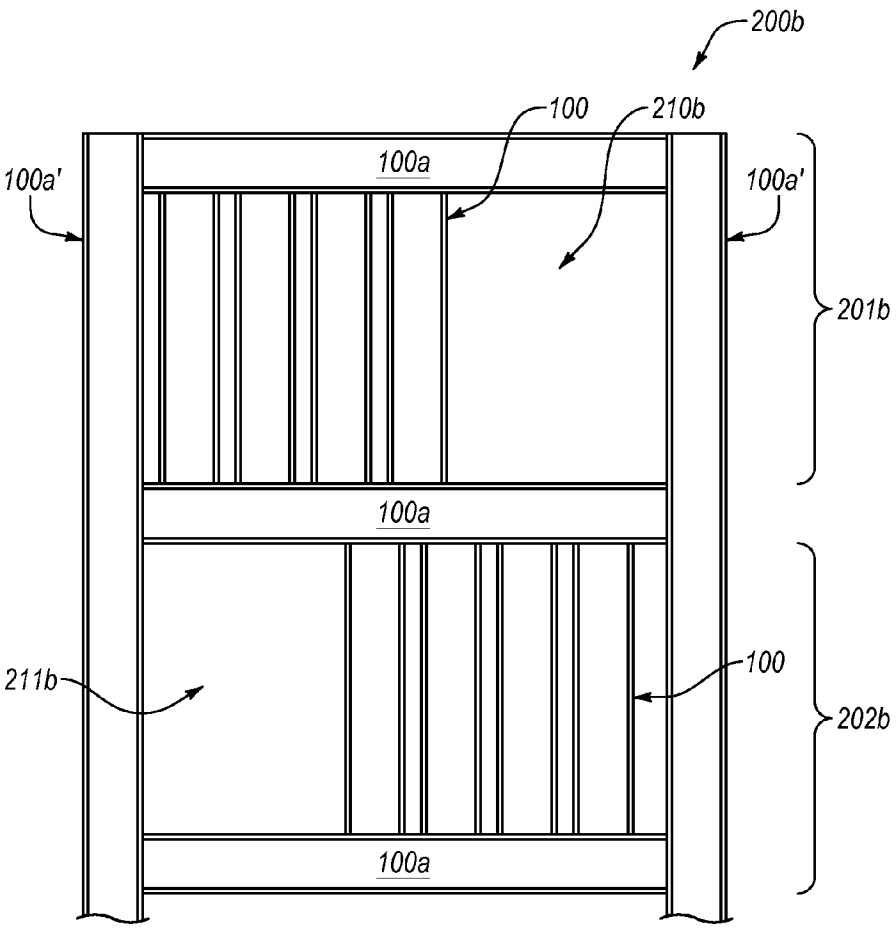
FIG. 15 is a front view of a moment resisting frame that includes one or more seismic beams according to yet another embodiment.
Figure 14:
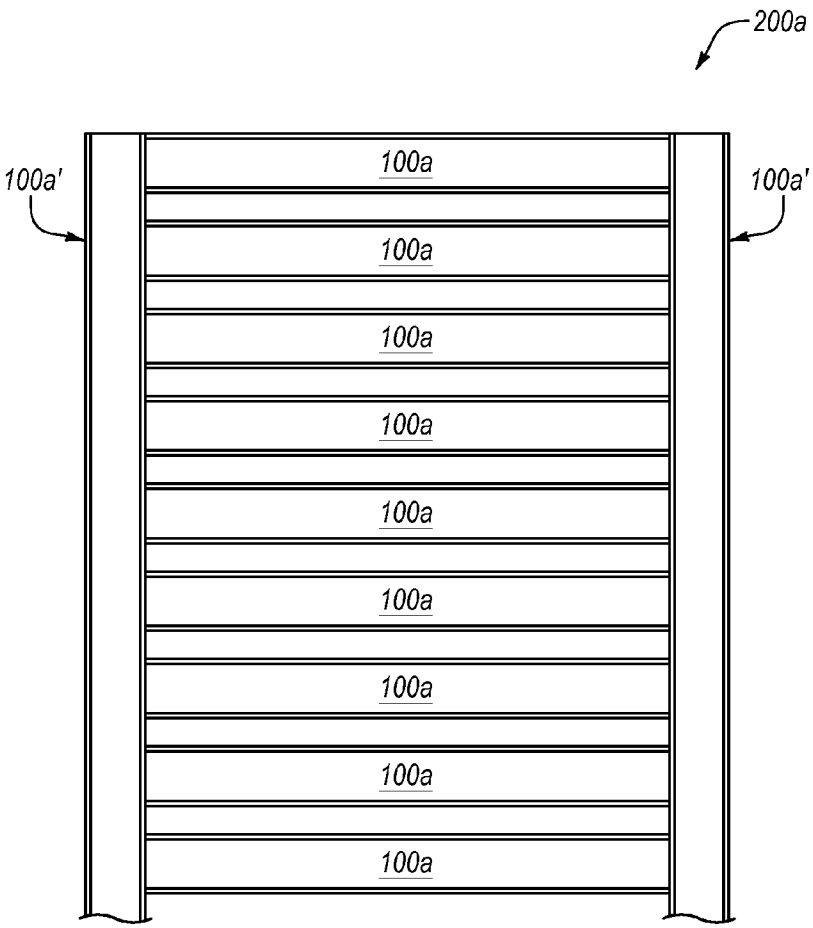
FIG. 14 is a front view of a moment resisting frame that includes one or more seismic beams according to another embodiment.

As mentioned above, the seismic beams described herein may be incorporated into and/or may form any number of structures. Although FIGS. 13-15 are illustrated as utilizing one or more of the seismic beams 100*a* shown in FIG. 2, any of the seismic beams disclosed herein may be used instead of the seismic beam 100*a*, such as the seismic beam 100*c*-100*e* shown in FIGS. 4-6, respectively. Additionally, as used herein including the claims, the terms "horizontal" or variants thereof and "vertical" or variants thereof include deviations from perfectly horizontal or perfectly vertical and are used herein merely for simplicity and convenience.

FIG. 13 illustrates a moment-resisting frame 200 according to an embodiment. For example, the moment-resisting frame 200 may include one or more horizontally oriented seismic beams 100*a* rigidly connected to and between opposing vertical seismic beams 100*a*'. In other words, the moment-resisting frame 200 may include rigid joints between the seismic beams 100*a*' and the seismic beam(s) 100*a*. For instance, the seismic beams 100*a* may be welded to the seismic beams 100*a*' at connection locations therebetween.

Additionally or alternatively, the rigid joints between the seismic beams 100*a* and seismic beams 100*a*' may include bracketed and/or bolted connections. In any event, in at least one embodiment, application of a lateral force F or F' to the moment-resisting frame 200 may produce bending and/or twisting (e.g., elastic or plastic deformation) of the seismic beams 100*a* and/or seismic beams 100*a*', while the joints therebetween may rigidly hold the seismic beams 100*a* and seismic beams 100*a*' together. Moreover, in some embodiments, each of the vertical seismic beams 100*a*' may include a single continuous beam or multiple beams connected together (e.g., welded, fastened together, etc.).

In some embodiments, at the connection locations or joint locations between the seismic beams 100*a*' and the seismic beams 100*a*, the flanges of the seismic beams 100*a*' may have the widest portions. In other words, the seismic beams 100*a*' may have a greatest moment of inertia at the connection locations with the seismic beams 100*a*, and the respective moments of inertia may decrease from the connections locations along the longitudinal axis of the seismic beams 100*a*'. Furthermore, in some embodiments, as described above, moments of inertia of the seismic beams 100*a*' may alternate along the longitudinal axes thereof. For example, the moments of inertia of the seismic beams 100*a*' may decrease along the longitudinal axes thereof from a first connection location to an intermediate location and increase to a second connection location (e.g., with another seismic beam 100*a*) along the respective longitudinal axis.

In some embodiments, the intermediate location may be approximately midway between the first and second connection locations. As mentioned above, the moment of inertia may be varied along the seismic beams in any number of suitable ways. For example, at least one portion of one or more of the flanges may be generally tapered or having widths reducing along the longitudinal axis of the seismic beam. In an embodiment, width of the flanges of the seismic beams 100*a*' may decrease from the first connection location to the intermediate location with distance along the longitudinal axes of the seismic beams 100*a*'. Moreover, the width of the flanges of the seismic beams 100*a*' may increase from the intermediate location to the second connection location. For instance, the widest portion of the flanges of the seismic beams 100*a*' may be located at or near the connection locations or joints with the seismic beams 100*a*.

As mentioned above, in some examples, application of force F and/or F' to the moment-resisting frame 200 may produce an approximately even or balanced distribution of bending stresses along the respective longitudinal axes of the seismic beams 100*a* and/or 100*a*'. In other words, material in the seismic beams 100*a* and/or in the seismic beams 100*a*' may be distributed along respective longitudinal axes thereof in a manner that reduces the total amount of material required or suitable for withstanding the forces F and/or F' as compared to conventional I- or H-beams of approximately uniform cross-section along the longitudinal axes thereof.

In some embodiments, the moment-resisting frame 200 may include two or more seismic beams 100*a*, the may extend horizontally between the seismic beams 100*a*'. It should be appreciated, however, the moment-resisting frames may include any number of seismic beams or columns described herein, which may have any number of suitable orientations. FIG. 14, for example, illustrates a moment-resisting frame 200*a* that includes numerous horizontally oriented seismic beams 100*a* rigidly connected to and extending between opposing vertical seismic beams 100*a*'. In some instances, the moment-resisting frame 200*a* may include increased the number of horizontal seismic beam 100*a* having decreased sizes (e.g., flange widths and/or web heights), and may maintain resistance to the same forces F and/or F'. Additionally or alternatively, increasing the number of horizontal seismic beams 100*a*, while maintaining sizes thereof may allow the moment-resisting frame 200*a* to withstand greater lateral forces (as compared with a moment-resisting frame having fewer horizontal seismic beams 100*a* of the same size).

Moreover, in some embodiments, the horizontal and vertical seismic beams and/or columns (e.g., seismic beams 100*a* and seismic beams 100*a*') may have alternatingly varying moment of inertia, as described above. In additional or alternative embodiments, however, the moment-resisting frames may have one or more seismic beams and/or columns that have reducing or increasing moments of inertia from a first location to a second location along the longitudinal axes thereon.

FIG. 15 illustrates a moment-resisting frame 200*b* that includes horizontal seismic beam 100*a* rigidly connected to and extending between opposing vertical seismic beam 100*a*'. The moment-resisting frame 200*b* includes vertical seismic beams 100 that may extend between horizontal seismic beams 100*a*. In some instances, the seismic beams 100 may be rigidly connected to the seismic beams 100*a*. Additionally or alternatively, one or more ends of the seismic beams 100 may be pivotally connected to the seismic beams 100*a* (e.g., allowing at least some pivoting about at least one axis). In any event, the seismic beams 100 may allow the moment-resisting frame 200*b* to absorb increased amount of energy or applied lateral force (e.g., during a seismic event and/or wind loading event), as compared with a moment-resisting frame that includes conventional beams and/or columns.

In one or more embodiments, the moment-resisting frame 200*b* may include one or more conventional beams. For example, in lieu of or in addition to the vertically oriented seismic beams 100*a*', the moment-resisting frame 200*b* may include conventional beams. Additionally or alternatively, any of the seismic beams 100*a* may be replaced with one or more conventional horizontal beams. For example, the uppermost and lowermost of the seismic beams 100*a* of the moment-resisting frame 200*b* may be replaced with conventional horizontal beams.

In some embodiments, the seismic beam 100 may have a higher moment of inertia at first ends thereof and lower moment of inertia at second ends thereof (as described above). For example, all first ends of the seismic beams 100 may be connected to the same seismic beam 100*a* and all of the second ends of the seismic beams 100 may be connected to another, opposing seismic beam 100*a*. Alternatively, some of the first ends of the seismic beams 100 may be connected to a first seismic beam 100*a*, while other first ends of the seismic beams 100 may be connected to a second, opposing seismic beam 100*a*. In other words, the orientation of the moment of inertia gradient along respective longitudinal axes of the seismic beams 100 may vary from one seismic beam 100 to another. In some examples, orientation of the moment of inertia gradient along respective longitudinal axes of the seismic beam 100 may alternate from one to another, such that the moment of inertia gradient of adjacent seismic beams 100 is oriented in opposing directions (e.g., upward and downward).

Generally, spacing between seismic beams 100 may vary from one embodiment to the next. Also, in one or more embodiments, the seismic beams 100 may connect opposing horizontal seismic beams 100*a* along a portion of the lengths of the seismic beams 100*a* or along substantially entire lengths thereof. Moreover, in some examples, the moment-resisting frame 200*b* may include upper and lower sections 201*b*, 202*b*. More specifically, the upper section 201*b* may include a first (e.g., top) seismic beam 100*a*, a second (e.g., middle) seismic beam 100*a*, and seismic beams 100 connected therebetween, and the lower section 202*b* may include the second seismic beam 100*a*, the third (e.g., bottom) seismic beam 100*a*, and seismic beams 100 connected therebetween.

In some embodiments, the seismic beams 100 in the upper section 201*b* may be connected along a first portion of the lengths of the seismic beams 100*a*, leaving an opening 210*b* that does not include seismic beams 100. Moreover, the seismic beams 100 in the lower section 202*b* may be connected along a second portion of the lengths of the seismic beams 100*a*, leaving an opening 211*b* in the lower section 202*b*, which may be geometrically opposite (e.g., a mirrored image) of the opening 210*b* in the upper section 201*b*. In any event, it should be appreciated that a particular pattern, spacing, and number of seismic beams 100 may vary from one embodiment to the next. Also, in some embodiments, the seismic beams 100*a* may be vertically oriented and connected to other seismic beams 100*a*. Furthermore, as mentioned above, any of the seismic beams described herein may be incorporated in any moment-resisting frame.

While various aspects and embodiments have been disclosed herein, other aspects and embodiments are contemplated. The various aspects and embodiments disclosed herein are for purposes of illustration and are not intended to be limiting.

What is claimed is:

1. A beam for fabrication of a moment-resisting frame, the beam comprising:

one or more webs extending along a longitudinal axis, the one or more webs including a first side and a second, opposite side; and a plurality of flanges connected to the one or more webs and extending along the longitudinal axis, at least one flange of the plurality of flanges being positioned on the first side of the one or more webs and at least another flange of the plurality of flanges being positioned on the second, opposite side of the one or more webs, each flange of the plurality of flanges having an approximately planar major side that is oriented approximately perpendicular to the one or more webs, each approximately major side having a width that gradually decreases along the longitudinal axis from a first location to a second location, the width of each approximately major side gradually increases along the longitudinal axis from the second location to a third location, the second location being positioned between the first location and the third location; and wherein the one or more webs and the plurality of flanges form a generally tubular shape.

2. A moment-resisting frame, comprising:

a first vertical beam;

a second vertical beam; and a first horizontal beam rigidly connected at a first end thereof to a first connection location on the first vertical beam and at a second end thereof to a second connection location on the second vertical beam;

wherein the first vertical beam, second vertical beam, and the first horizontal beam have a varying moment of inertia that decreases along a longitudinal axis thereof from a first location to a second location, the first vertical beam having a highest moment of inertia at the first connection location, and the second vertical beam having a highest moment of inertia at the second connection location.

3. The moment-resisting frame of claim 2 wherein the moment of inertia of at least one of the first vertical beam, second vertical beam, or the first horizontal beam increases along the longitudinal axis from the second location to a third location.

4. A moment-resisting frame, comprising:

a first vertical beam, including:

a first vertical web;

a first vertical flange connected to the first vertical web, the first vertical flange having a varying width, the varying width being greatest at a connection location and gradually decreasing along a longitudinal axis of the first vertical beam in a first direction from the connection location to a reduced width location;

a second vertical flange connected to the first vertical web;

a second vertical beam oriented approximately parallel to the first vertical beam;

a first horizontal beam rigidly connected at a first end thereof to the connection location on the first vertical beam and at a second end thereof to a connection location on the second vertical beam, the first horizontal beam including:

a first horizontal web having approximately vertical orientation;

a first horizontal flange connected to the first horizontal web and having an approximately horizontal orientation, the first horizontal flange having a width that is greater at and/or near the first end than at an intermediate location between the first end and the second end; and a second horizontal flange connected to the first web and having an approximately horizontal orientation.

5. The moment-resisting frame of claim 4 wherein the width of the first horizontal flange near the second end is greater than the width of the first horizontal flange at the intermediate location.

6. The moment-resisting frame of claim 5 wherein the intermediate location is approximately midway between the first end and the second end of the first horizontal beam.

7. The moment-resisting frame of claim 4 wherein the second horizontal flange has a greater width at and/or near the first end than at the intermediate location between the first end and the second end.

8. The moment-resisting frame of claim 5 wherein at least a portion of at least one of the first horizontal flange or the second horizontal flange has a generally tapered shape.

9. The moment-resisting frame of claim 8 wherein at least one of the first horizontal flange or the second horizontal flange has approximately linear sides.

10. The moment-resisting frame of claim 8 wherein at least one of the first horizontal flange or the second horizontal flange has nonlinear sides.

11. The moment-resisting frame of claim 5 wherein the second horizontal flange has a width that is greater at and/or near the second end than the width of the second horizontal flange at the intermediate location.

12. The moment-resisting frame of claim 11 wherein the first horizontal beam includes a second web connecting the first and second horizontal flanges together.

13. The moment-resisting frame of claim 12 wherein the first horizontal beam has a generally tubular shape.

14. The moment-resisting frame of claim 5 wherein the second vertical beam includes:

one or more webs; and a plurality of flanges connected to the one or more webs, at least one of the at least one flange having a first width at the connection location and a second width at an intermediate location that is spaced apart from the connection location, the second width being smaller than the first width.

15. The moment-resisting frame of claim 14, further comprising a second horizontal beam rigidly connected at a first end thereof to a second connection location on the first vertical beam and at a second end thereof to a second connection location on the second vertical beam.

16. The moment-resisting frame of claim 4 wherein the width of the first vertical flange of the first vertical beam gradually increases in the first direction from the reduced width location to another location.

17. The moment-resisting frame of claim 4 wherein a first portion of at least one of the first vertical beam or the second vertical beam extends between the connection location and the intermediate location and has a generally tapered shape.

18. The moment-resisting frame of claim 17 wherein a second portion of at least one of the first vertical beam or the second vertical beam extends between the second connection location and the intermediate location and has a generally tapered shape.

* * * * *